United States Patent [19]

Wermelinger

[11] 4,405,842

[45] Sep. 20, 1983

[54] STEPPING MECHANISM FOR AN ENCODING ROTARY SWITCH

[75] Inventor: Hans Wermelinger, Rümlang, Switzerland

[73] Assignee: Contraves AG, Zurich, Switzerland

[21] Appl. No.: 314,956

[22] Filed: Oct. 26, 1981

[30] Foreign Application Priority Data

Nov. 10, 1980 [CH] Switzerland ..... 8314/80

[51] Int. Cl.[3] ..... H01H 3/00

[52] U.S. Cl. ..... 200/17 R; 200/11 TW

[58] Field of Search ..... 200/11 R, 11 TW, 14, 200/17 R, 18, 153 P, 156, 336

[56] References Cited

U.S. PATENT DOCUMENTS

| | | | |
|---|---|---|---|
| 3,133,164 | 5/1964 | Dennison et al. | 200/5 R |
| 3,195,358 | 7/1965 | Davidson et al. | 74/10.1 |
| 3,229,052 | 1/1966 | Silvius et al. | 200/14 X |
| 3,257,535 | 6/1966 | Sallin et al. | 200/156 |
| 3,499,127 | 3/1970 | Cherry et al. | 200/17 R |
| 3,654,413 | 4/1972 | Jordan et al. | 200/156 |
| 3,818,155 | 6/1974 | Lockard | 200/18 |
| 3,958,087 | 5/1976 | Mol et al. | 200/156 X |
| 4,257,283 | 3/1981 | Haller et al. | 200/156 X |

FOREIGN PATENT DOCUMENTS

| | | |
|---|---|---|
| 1014627 | 8/1957 | Fed. Rep. of Germany . |
| 2188277 | 1/1974 | France . |

*Primary Examiner*—J. R. Scott

*Attorney, Agent, or Firm*—Werner W. Kleeman

[57] ABSTRACT

A stepping or indexing mechanism for an encoding rotary or multi-position switch is arranged within a switch housing. The stepping mechanism comprises a symbol or numeric wheel, two substantially mirror-image and mutually symmetrically arranged locking or latching levers, a locking or latching wheel, a gear meshing with the symbol or numeric wheel as well as a switching or indexing element arranged laterally at the switch housing. The locking or latching levers are movably mounted at one end in a bearing or support element and at the other end are structured for the rotatable mounting of a related roller. The latching levers are drawn together with the rollers by a tension spring or equivalent structure into latching or locking recesses of the locking wheel. For the switching operation the locking levers are deflected against the restoring force of the spring out of the locking recesses, and the rollers then slide along locking or latching cams or dogs provided with arcuate-shaped flank profiles. The stepping or indexing mechanism insures for an exact switch or indexing operation which can be positively transmitted to the symbol or numeric wheel.

2 Claims, 4 Drawing Figures

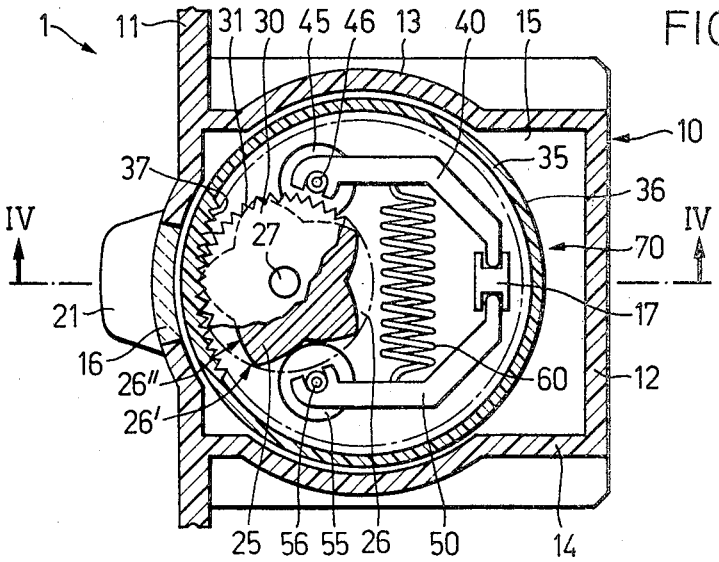
FIG. 1
FIG. 2
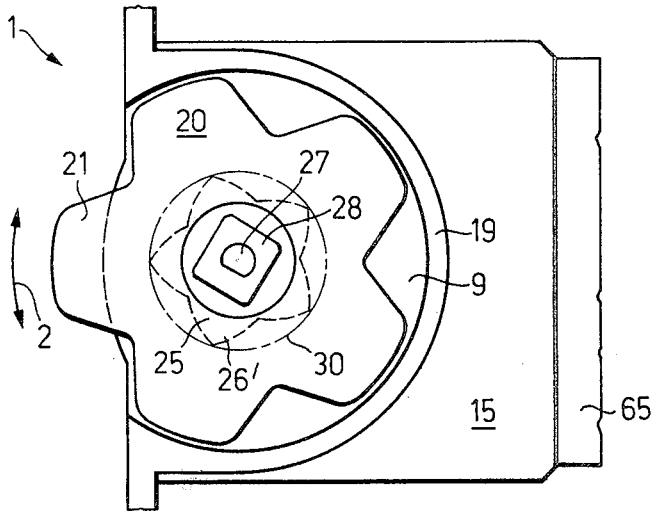
FIG. 3
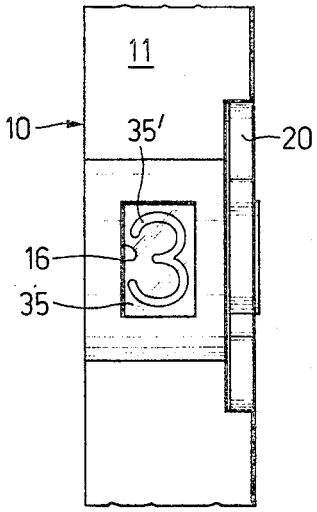
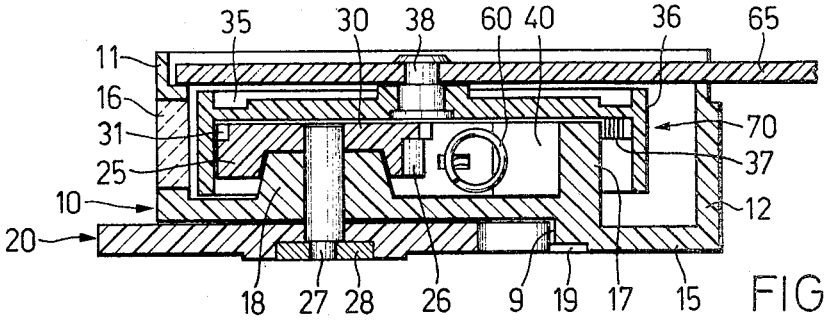
FIG. 4

STEPPING MECHANISM FOR AN ENCODING ROTARY SWITCH

BACKGROUND OF THE INVENTION

The present invention relates to a new and improved construction of a stepping or indexing mechanism for an encoding rotary or multi-position switch.

Generally speaking, the stepping or indexing mechanism of the present development is of the type comprising a symbol or numeric wheel arranged in a switch housing, broadly simply referred to as a character wheel, a switching or indexing element and a locking or latching device which essentially embodies a locking or latching wheel and at least one locking or latching lever which is mounted at one end in the switch housing and resiliently engages at its other end with the locking wheel.

In German Patent No. 1,186,124, published Jan. 28, 1965, there is disclosed an electrical rotary or multi-position switch having a locking or latching device containing a locking or latching wheel and two mirror-image symmetrically arranged locking or latching levers. With the heretofore known construction of the locking wheel the flanks of the locking cams possess a sawtooth-like curved configuration and there engage into the locking recesses of the locking wheel a semi-circular shaped projection or extension which is formed at the related locking lever. At the other end each locking lever possesses a semi-circular shaped recess into which engages a bearing or support portion mounted in the switch housing and constructed as a pivotable element. The locking levers are pressed by means of a respective compression or pressure spring, which are essentially supported at the switch housing, together with the thereat formed projection into the locking or latching recess. Upon actuation of the switch the locking lever together with its projection slides along the locking cam flank and at the same time such is deflected out of the locking or latching recesses.

With the heretofore known construction of rotary or multi-position switch the relatively complicated construction of the locking or latching lever, on the one hand, as well as the arrangement of the locking or latching levers, springs and the pivotal element, on the other hand, necessitates an increased number of working steps during the fabrication and assembly of the rotary switch. Additionally, this latching device in its existing construction is not suitable for use with a multi-position selector switch or thumbwheel switch, also referred to in the art as an encoding rotary or thumbwheel switch.

Other exemplary constructions of rotary switches have been disclosed, for instance, in French Patent No. 2,188,277, published Jan. 18, 1974, German Patent Publication No. 1,014,627, published Aug. 29, 1957, and U.S. Pat. Nos. 3,133,164; 3,195,358; 3,499,127; and 3,654,413.

SUMMARY OF THE INVENTION

Therefore, with the foregoing in mind it is a primary object of the present invention to provide a new and improved construction of stepping or indexing mechanism for an encoding rotary or multi-position switch which is not associated with the aforementioned drawbacks and limitations of the prior art constructions.

Another and more specific object of the present invention aims at providing a new and improved construction of a stepping or indexing mechanism for an encoding rotary switch of the previously mentioned type wherein the switching or indexing and locking elements ensure for an exactly transmittable switching operation to the symbol or numeric wheel.

Another important object of the present invention and in keeping with the immediately preceding object is to enable actuation of the multi-position switch in a positive manner even when confronted with adverse environmental or operating conditions, such as when there is a need to operate the switch while the operator or user is wearing gloves for instance.

Still a further significant object of the present invention is directed to devising a new and improved construction of stepping mechanism for an encoding rotary or multi-position switch which is relatively simple in construction and design, easy and economical to fabricate and assemble, requires very little maintenance and servicing, is extremely reliable in operation and not readily subject to breakdown or malfunction.

Now in order to implement these and still further objects of the invention which will become more readily apparent as the description proceeds, the stepping mechanism for an encoding rotary switch of the present development comprises a symbol or numeric wheel, generically referred to simply as a character wheel, which is arranged in a switch housing. A switching or indexing element is arranged eccentrically with respect to the character wheel and there is provided a locking or latching device which essentially comprises a locking or latching wheel and two locking or latching levers. Importantly, there is provided a gear having external teeth which engage with internal teeth of the character wheel. This gear is arranged in spaced relationship and in axially parallel correlation to the character wheel. The gear is rotatable about a first pivot shaft or pin. The gear is rotatably mounted about a second pivot shaft or pin. The locking or latching levers are arranged in mirror-image relationship symmetrically to both sides of the locking wheel which is rotatable together with the gear about the second pivot shaft. Each locking lever is mounted so as to have one end arranged in the switch housing and at the other end each such locking lever is provided with a rotatably mounted roller. The locking levers can be deflected out of their locking or latching position, where they engage by means of their rollers with the locking wheel, against the restoring force of a single spring attached at both locking levers.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a sectional view of an encoding rotary or multi-position switch constructed according to the present invention;

FIG. 2 illustrates the encoding rotary switch shown in FIG. 1 looking in the direction of the switching or indexing element;

FIG. 3 is a front view of the operating side of the encoding rotary switch depicted in FIG. 2; and FIG. 4 is a sectional view, on an enlarged scale, of the encoding rotary switch shown in FIG. 1, taken substantially along the line IV—IV thereof.

DETAILED DESCRIPTION OF THE PREFERRED EMBODIMENTS

Describing now the drawings in FIGS. 1 to 4 there is illustrated an exemplary embodiment of an encoding rotary or multi-position switch 1. This rotary switch 1 essentially contains a housing 10, a symbol or numeric wheel 35, as previously mentioned generally referred to herein as simply a character wheel, a current circuit board or printed circuit board 65 and a stepping or indexing mechanism 70 arranged within the switch housing 10. The stepping or indexing mechanism 70 embodies a locking or latching wheel 25, a gear 30 and two mirror-image mutually symmetrically arranged locking or latching levers 40 and 50. The stepping or indexing mechanism 70 can be actuated by a switching or indexing element 20 rotatably mounted laterally at one housing wall of the switch 1.

FIG. 1 shows in sectional view the encoding rotary or multi-position switch 1. There will be specifically recognized the switch housing 10 which is preferably formed from a suitable plastics material. This switch housing 10 is constituted by an end or front wall 11, a rear wall 12, an upper wall 13, a lower wall 14 and a side wall 15. At the side opposite the side wall 15 the switch housing 10 possesses a here not further designated opening which, following the assembly of the stepping mechanism 70, can be closed by means of the printed circuit board 65 or equivalent structure. Both of the walls 13 and 14 and the end wall 11 of the housing 10, in the embodiment under discussion, are accommodated at the region of the character wheel 35 to the outer contour of such character wheel. At the end or front wall 11 there is additionally provided a window 16, by means of which there can be read a number or, however, any appropriate symbol 35, in other words any suitable character or the like which is applied to the end face or circumferential surface 36 of the character wheel 35. The locking or latching wheel 25 is provided with locking or latching recesses 26 which are essentially uniformly distributed about the circumference of the locking wheel 25. This locking wheel 25 is also provided with locking or latching cams or dogs 26' which possess an arcuate-shaped configured flank profile 26''. Also, the locking or latching wheel 25 is preferably formed of one piece or integrally with the gear 30 and, as more fully depicted in FIG. 4, mounted at a projection or extension 18 formed at the inside or inner surface of the housing side wall 15.

In order to enhance the illustration of the locking or latching wheel 25 the gear 30 has been partially shown cutaway in FIG. 1. The character wheel 35 is rotatably mounted at the printed circuit board 65 about a first pivot shaft or pin 38 or equivalent structure. This character wheel 35 is operatively connected by means of internal teeth 37 with external teeth 31 of the gear 30, as the same has been shown in greater detail in the sectional view of FIG. 1. Each of the two mirror-image, mutually symmetrically arranged and flexed or bent locking or latching levers 40 and 50 are movably mounted at one end in a bearing or support element 17. The bearing element 17 is formed at the inner side of the housing side wall 15. At its other end each locking or latching lever 40 and 50 is constructed to be fork-shaped or bifurcated for mounting a related roller 45 and 55 so as to be rotatable about a related pivot shaft or pin 46 and 56, respectively. The rollers 45 and 55 which are mounted at the related locking or latching levers 40 and 50 are pressed or drawn into contacting relationship with the related locking or latching recess 26 of the locking wheel 25 by the action of a tension spring 60. This tension spring 60 is secured in any suitable fashion at the locking levers 40 and 50.

Now in FIG. 2 the encoding rotary or multi-position switch 1 has been shown in end view and there will be recognized the switching or indexing element 20 which is rotatably mounted at the side wall 15 of the switch housing 10. The switching or indexing element 20 is provided, for instance, with five switching fingers or knobs 21 or equivalent structure and is rotatable about a second pivot shaft or pin 27 in the direction of the double-headed arrow 2. FIG. 2 also illustrates the locking or latching wheel 25 containing the locking or latching cams or dogs 26' arranged in corresponding fashion to the switching or indexing fingers 21. There will also be recognized the likewise schematically shown gear 30 and a portion of the printed circuit board 65.

In FIG. 3 there is shown in front view with respect to the illustration of FIG. 2 part of the operating or servicing side of the encoding rotary or multi-position switch 1. Specifically, there will be recognized the end wall 11 of the switch housing 10, the viewing or observation window 16, a portion of the character wheel 35 containing a character 35', here a numeric symbol, as well as the switching or indexing element 20 arranged laterally of the switch housing 10.

FIG. 4 illustrates the encoding rotary switch 1 in sectional view, taken substantially along the line IV—IV of FIG. 1. There will be recognized the substantially box-shaped configured switch housing 10 which, as stated before, is formed essentially by the front or end wall 11, the rear wall 12 and the side wall 15. As also mentioned, this switch housing 10 is essentially closed by the printed circuit board 65 at the side thereof located opposite to the housing wall 15. At the outer side of the wall 15 there is arranged the switching or indexing element 20 in a recess or depression 9. This switching or indexing element 20 is rigidly connected for rotation with the second pivot shaft or pin 27 by means of a securing disc or element 28 or any other equivalent fastening structure. The locking or latching wheel 25 which bears upon the projection or extension 18 and the gear 30 are likewise rigidly connected for rotation in any suitable fashion with the pivot shaft 27 which is rotatably mounted in the projection or extension 18. Additionally, there will be seen in FIG. 4 the character wheel 35 which is rotatably mounted by means of a first pivot shaft or pin 38 at the printed circuit board 65. This character wheel 35 meshes by means of its internal teeth 37 with the external teeth 31 of the gear 30.

For the purpose of sealing a number of encoding rotary or multi-position switches which are assembled together in a row there is provided in conventional fashion a groove 19 at the outer side or surface of the wall 15. As shown more specifically in FIG. 2 this groove 19 extends essentially parallel to the essentially circular-shaped configured recess 9 which is provided for receiving the switching of indexing element 20.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A stepping mechanism for an encoding rotary switch comprising:

a switch housing;

a character wheel rotatably arranged in said switch housing;

an indexing element arranged eccentrically with respect to said character wheel;

a locking device which comprises a locking wheel and two locking levers;

each said locking lever having opposed ends;

one of said ends of each locking lever being mounted in said switch housing and the other end resiliently engaging with said locking wheel;

a first pivot shaft at which there is rotatably mounted said character wheel;

a gear provided with external teeth;

a second pivot shaft at which there is rotatably mounted said gear;

said gear being arranged in spaced relationship from and substantially axially parallel to the character wheel;

said character wheel having internal teeth which mesh with said external teeth of said gear;

said locking wheel being rotatably mounted at said second pivot shaft;

said locking levers being arranged substantially mirror-image symmetrically to opposite sides of the locking wheel;

a respective roller rotatably mounted at said other end of each locking lever;

a single spring secured to both locking levers; and said single spring acting upon said locking levers for placing the locking levers into engagement by means of said roller with the locking wheel into their latching position and said locking levers being deflectable against the restoring force of said single spring out of their latching position.

2. The stepping mechanism as defined in claim 1, wherein:

said gear and locking wheel are formed of one piece;

said locking wheel containing a plurality of locking recesses; and said locking recesses constituting locking cams containing a substantially arc-shaped flank profile and said locking cams being substantially uniformly arranged at the circumference of the locking wheel.

* * * * *